US007927128B2

(12) United States Patent
Jenving

(10) Patent No.: US 7,927,128 B2
(45) Date of Patent: Apr. 19, 2011

(54) DEVICE FOR A CONNECTOR HAVING A FRAME AND A CASING DETACHABLY CONNECTED

(76) Inventor: Tommy Jenving, Svenshögen (SE)

( * ) Notice: Subject to any disclaimer, the term of this patent is extended or adjusted under 35 U.S.C. 154(b) by 0 days.

(21) Appl. No.: 12/743,262

(22) PCT Filed: Nov. 14, 2008

(86) PCT No.: PCT/SE2008/051312

§ 371 (c)(1),
(2), (4) Date: May 17, 2010

(87) PCT Pub. No.: WO2009/067075

PCT Pub. Date: May 28, 2009

(65) Prior Publication Data

US 2010/0255711 A1 Oct. 7, 2010

(30) Foreign Application Priority Data

Nov. 19, 2007 (SE) ..... 0702534

(51) Int. Cl.
*H01R 13/58* (2006.01)

(52) U.S. Cl. ..... 439/465

(58) Field of Classification Search ..... 439/465, 439/452, 394, 669, 367, 160
See application file for complete search history.

(56) References Cited

U.S. PATENT DOCUMENTS

| | | | | |
|---|---|---|---|---|
| 4,005,922 | A * | 2/1977 | Burkhart et al. | 439/465 |
| 4,708,414 | A * | 11/1987 | Lam | 439/394 |
| 5,083,934 | A * | 1/1992 | Kawaguchi | 439/394 |
| 5,482,475 | A * | 1/1996 | Kawaguchi | 439/394 |
| 6,312,281 | B1 * | 11/2001 | Rodriguez | 439/394 |
| 7,008,256 | B2 * | 3/2006 | Poiraud | 439/394 |
| 2002/0182940 | A1 * | 12/2002 | Haas et al. | 439/669 |

* cited by examiner

*Primary Examiner* — Chandrika Prasad
(74) *Attorney, Agent, or Firm* — Potomac Patent Group PLLC

(57) ABSTRACT

The invention relates to a device (1) for an electrical contact (2) that comprises a frame part (3) and a casing (4) that is arranged to be detachably interconnected with the frame part (3) as well as a connecting part (34) for a cable and having a contact pin (6) or pin reception part, respectively, situated at mutually opposite portions (3A, 3B) of the frame part (3). The casing (4) has an opening (7) for surrounding receipt of a portion (3B) of the frame part (3) extending through the opening (7). Co-operating fastening members (8-10) are arranged to detachably interconnect the frame part (3) with the casing (4).

15 Claims, 13 Drawing Sheets

DEVICE FOR A CONNECTOR HAVING A FRAME AND A CASING DETACHABLY CONNECTED

Figure 1:
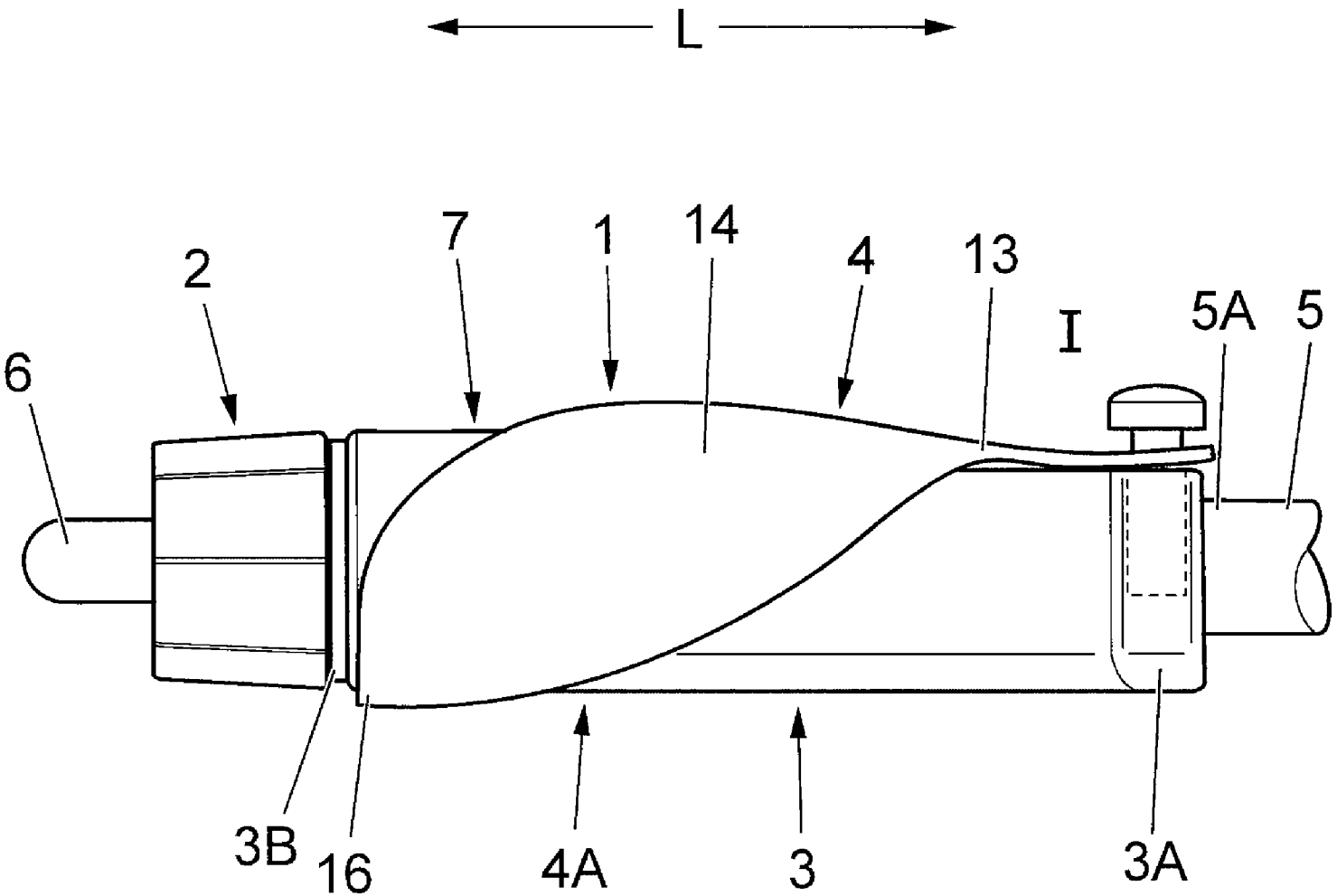
Figure 2:
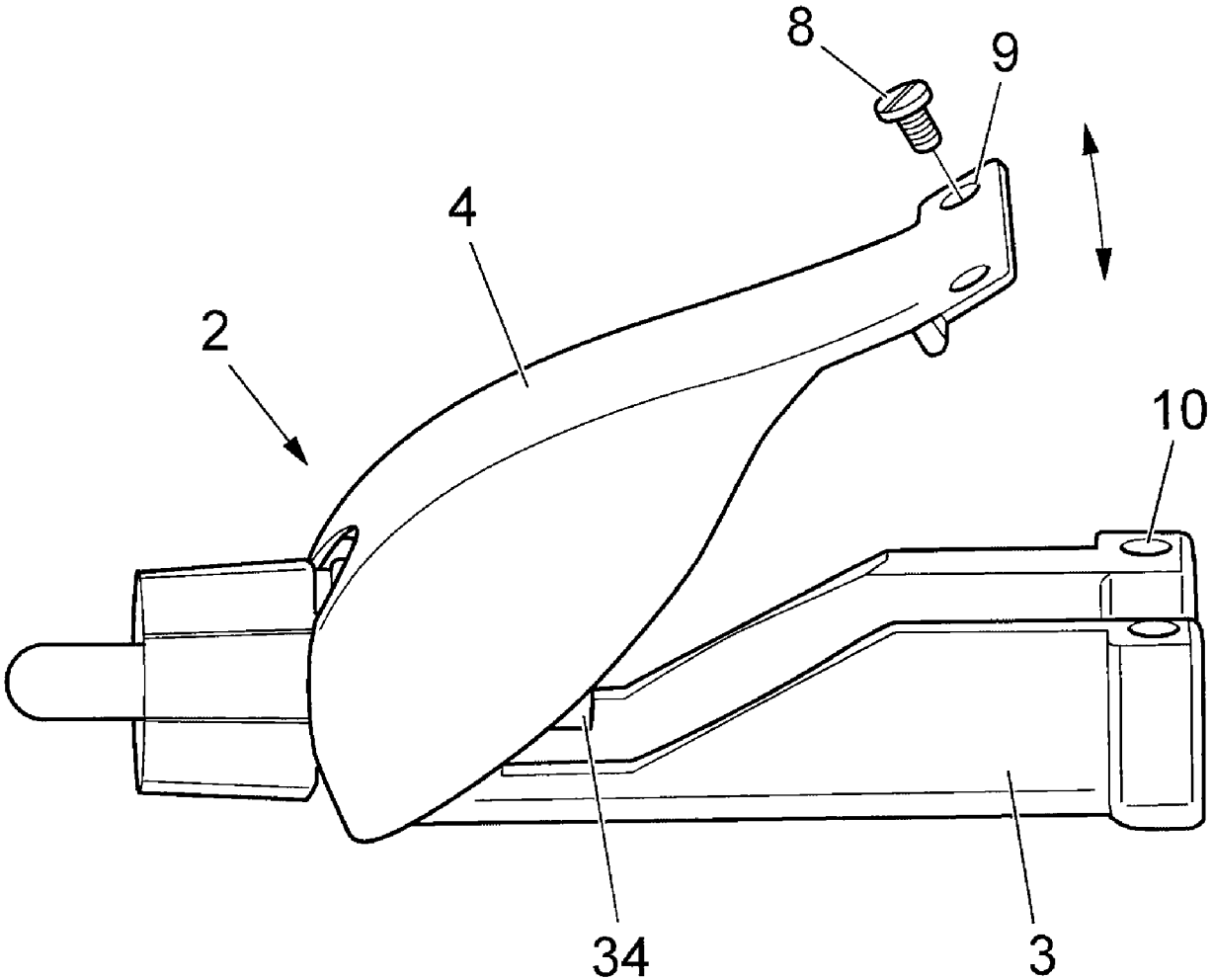
Figure 3:
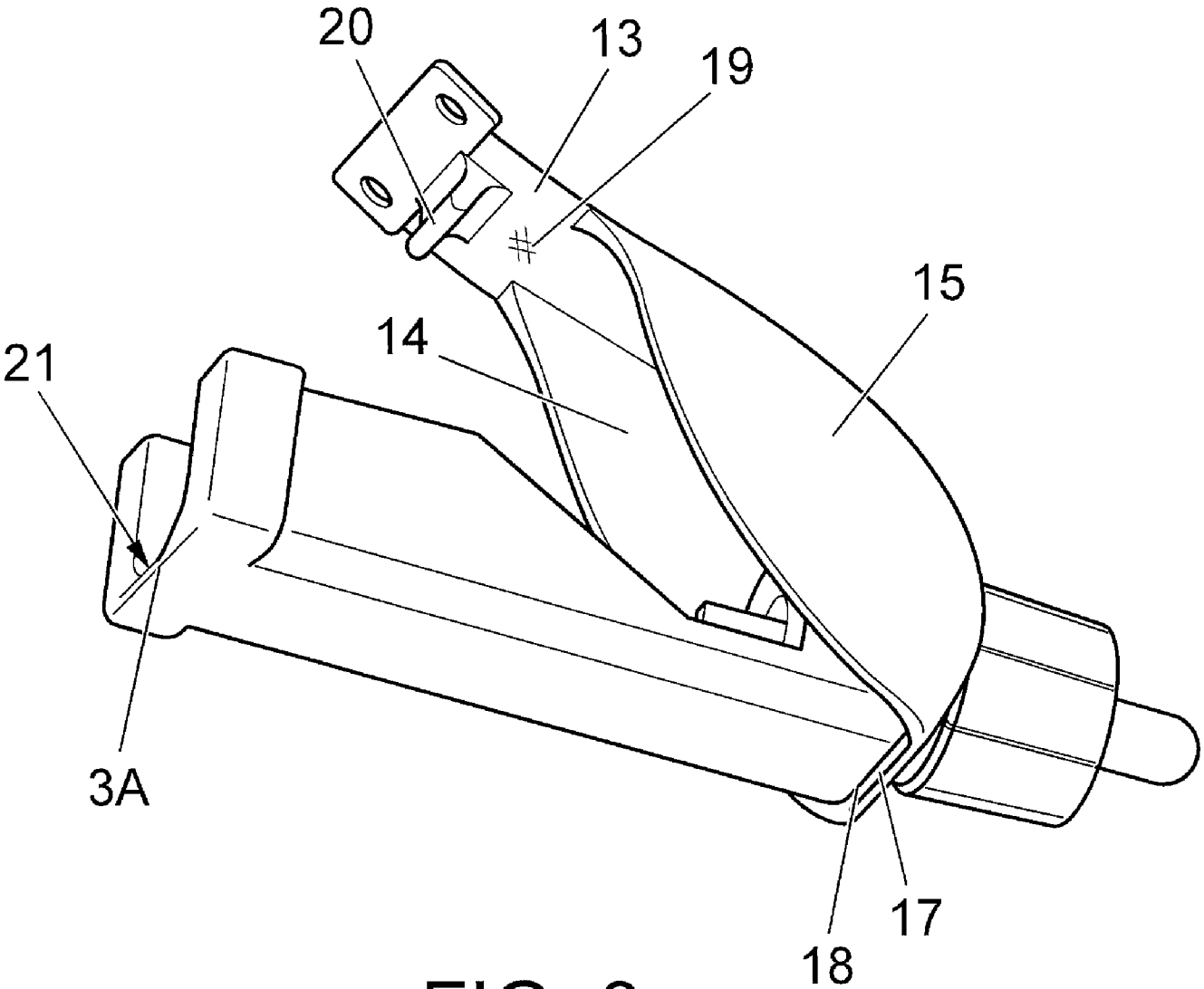
Figure 4:
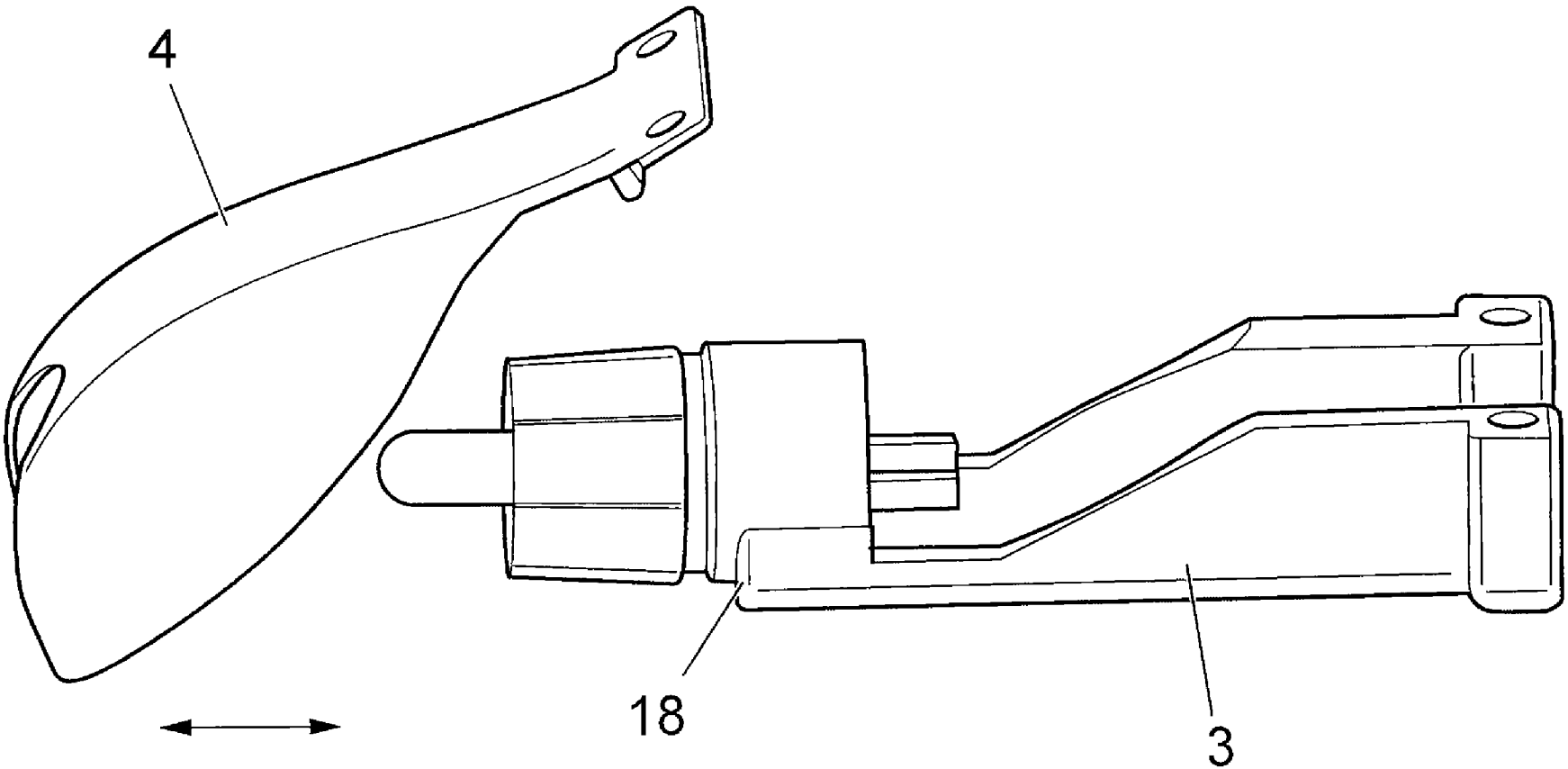
Figure 5:
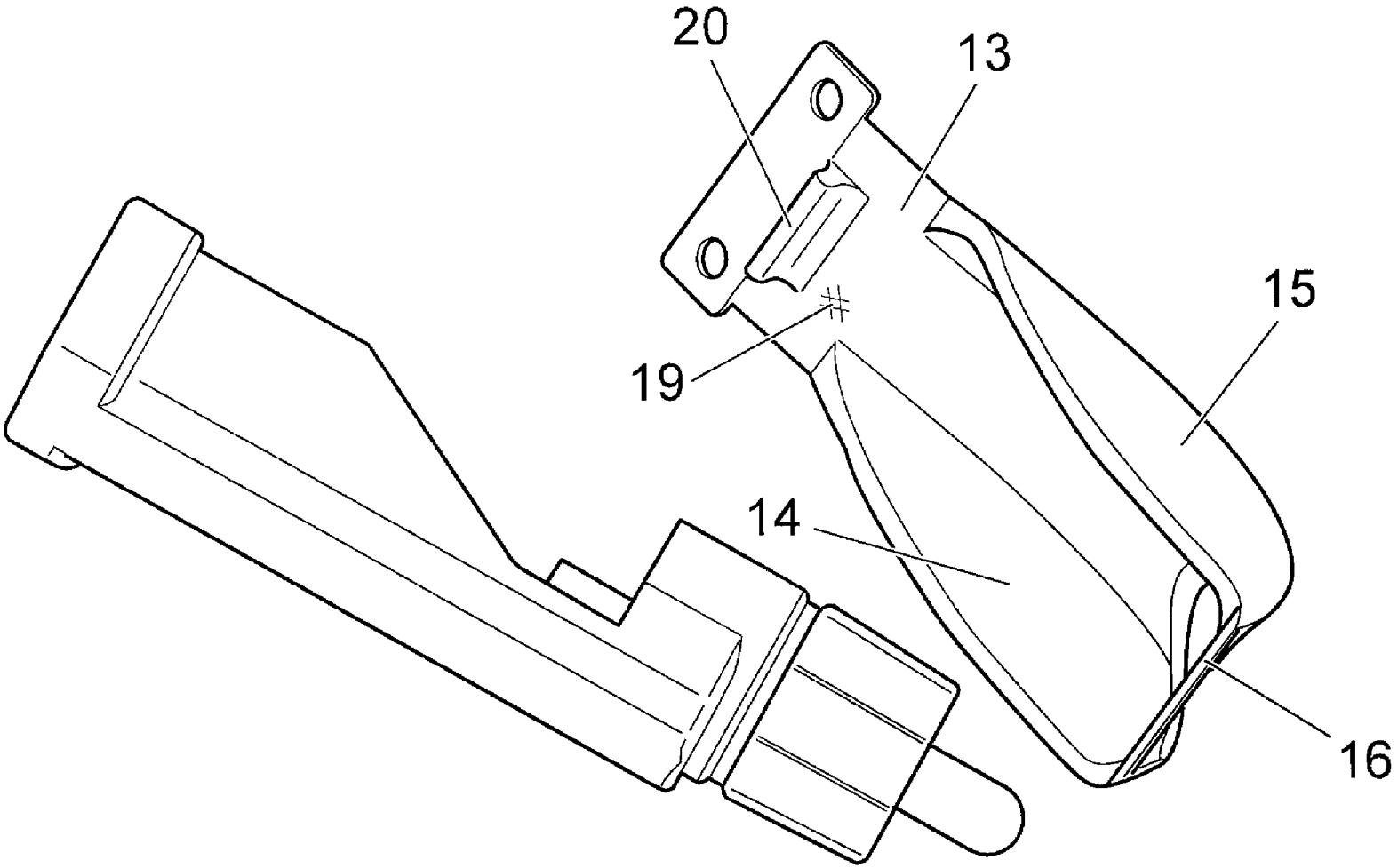
Figure 6:
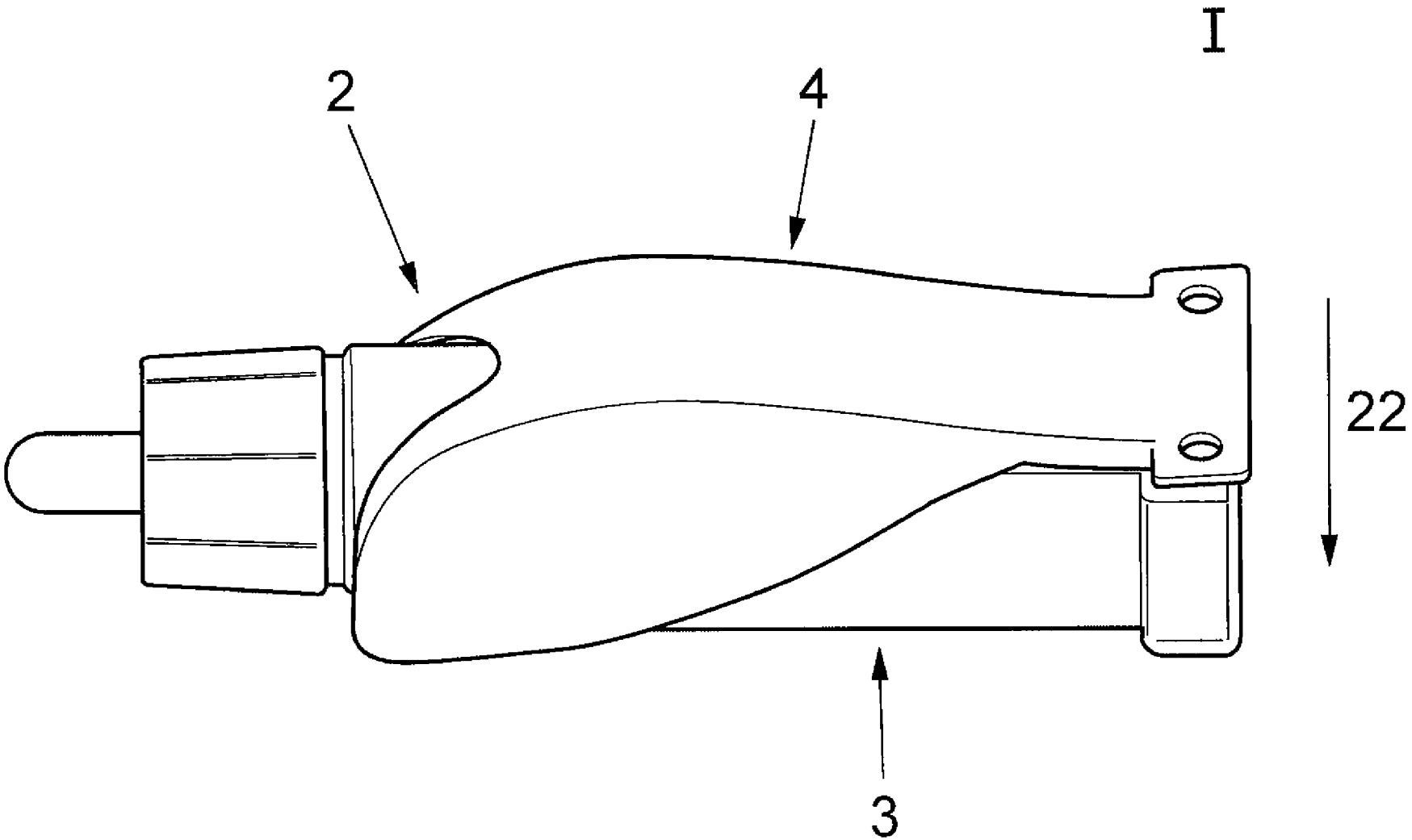
Figure 7:
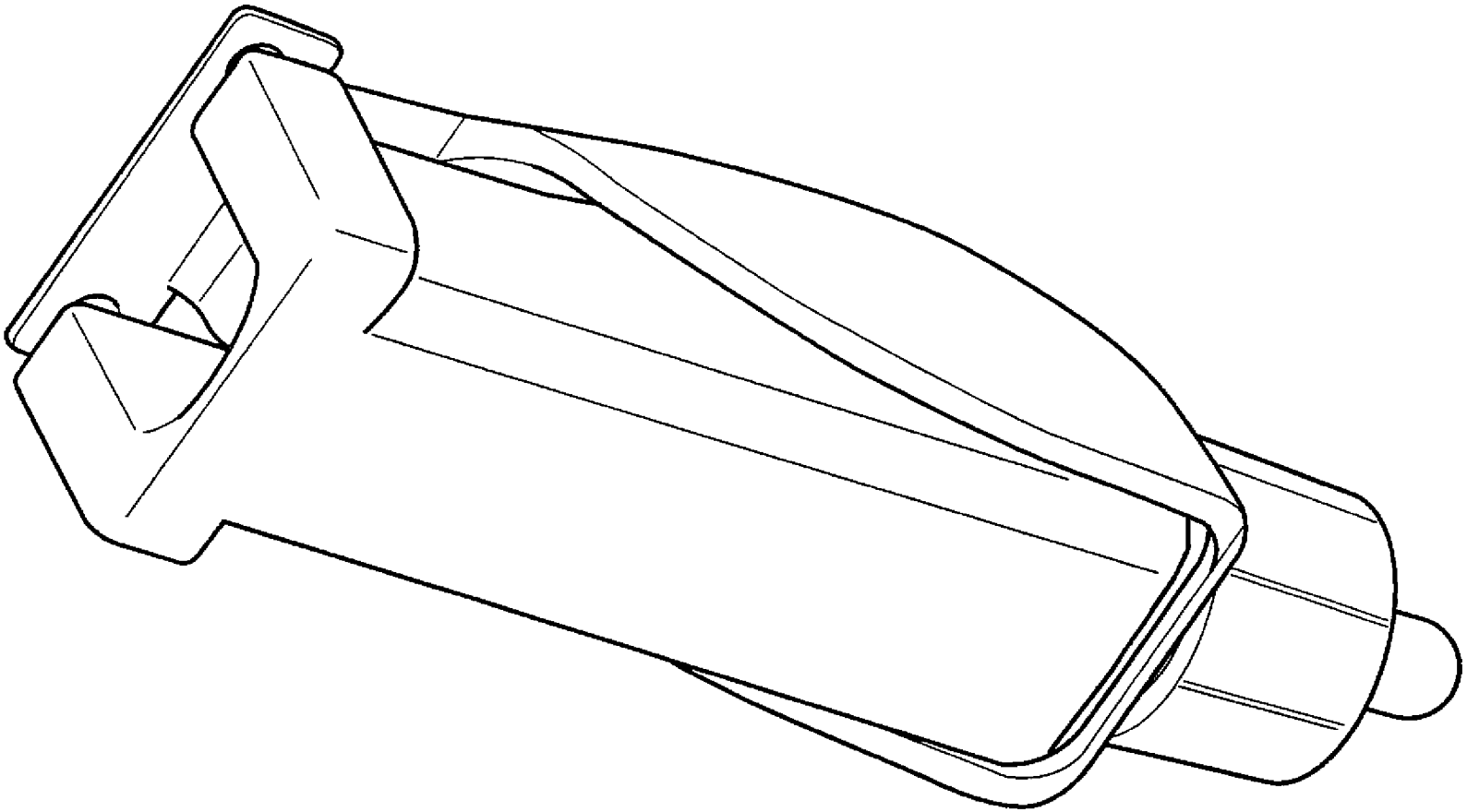
Figure 8:
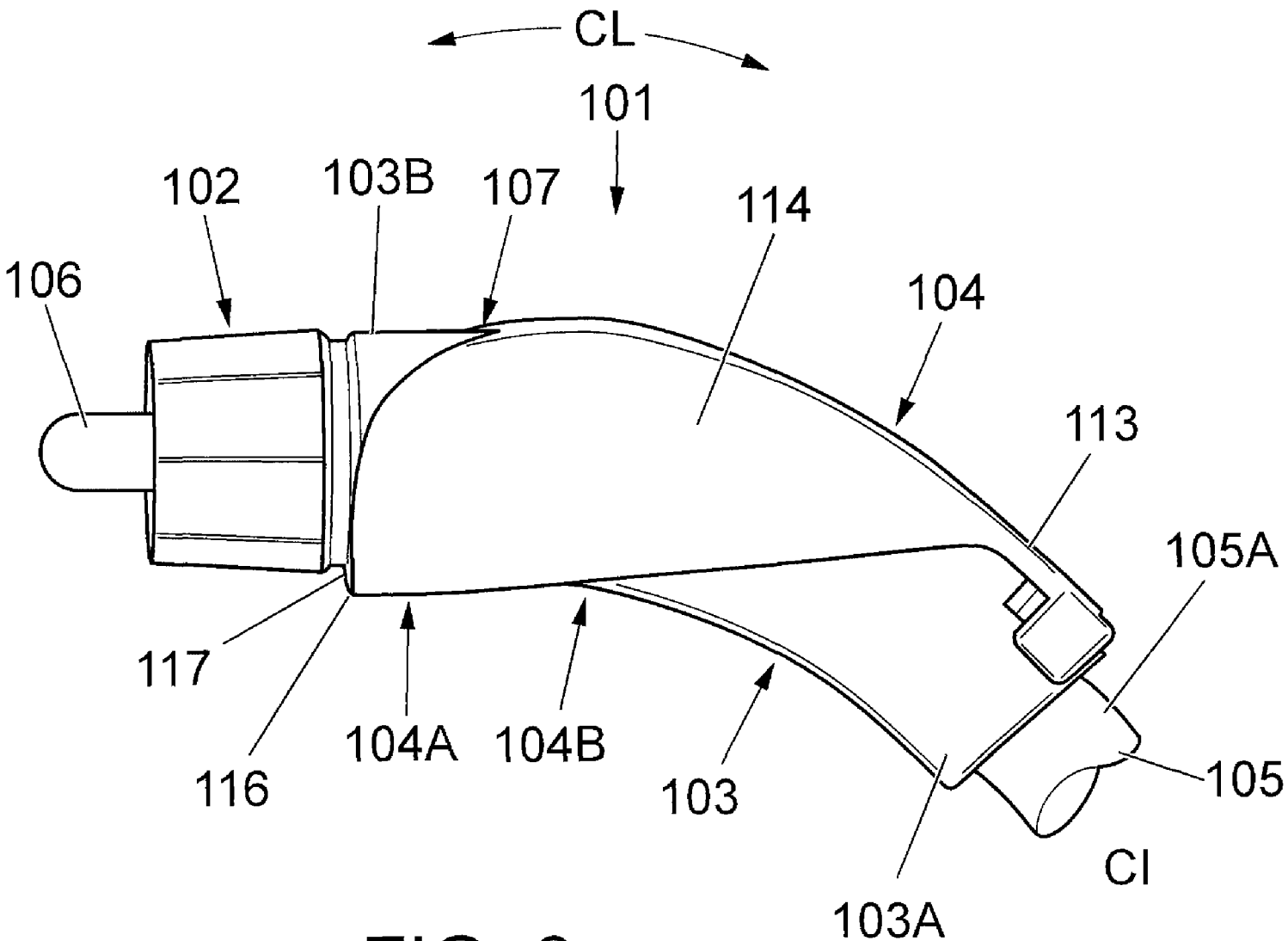
Figure 9:
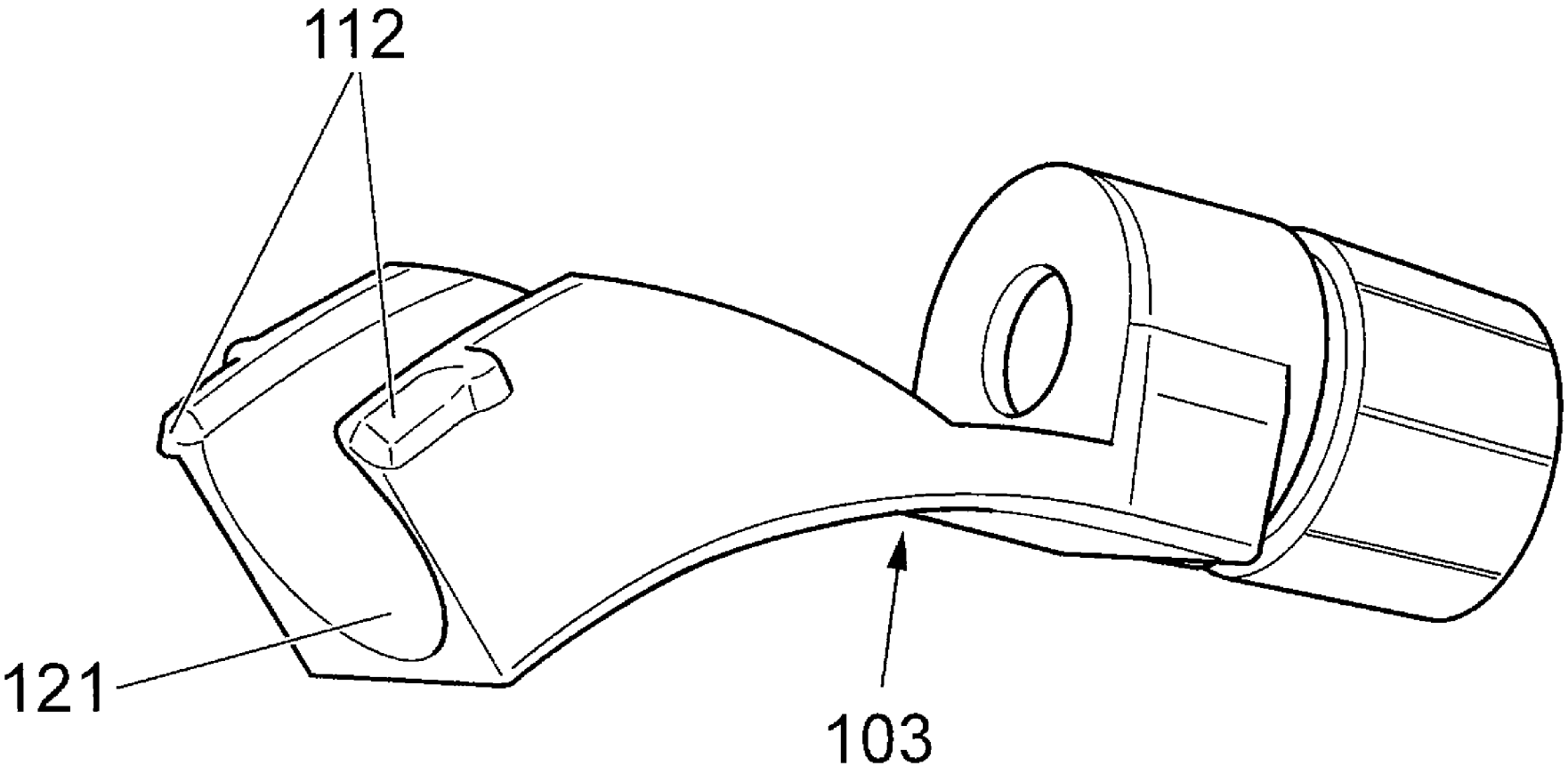
Figure 10:
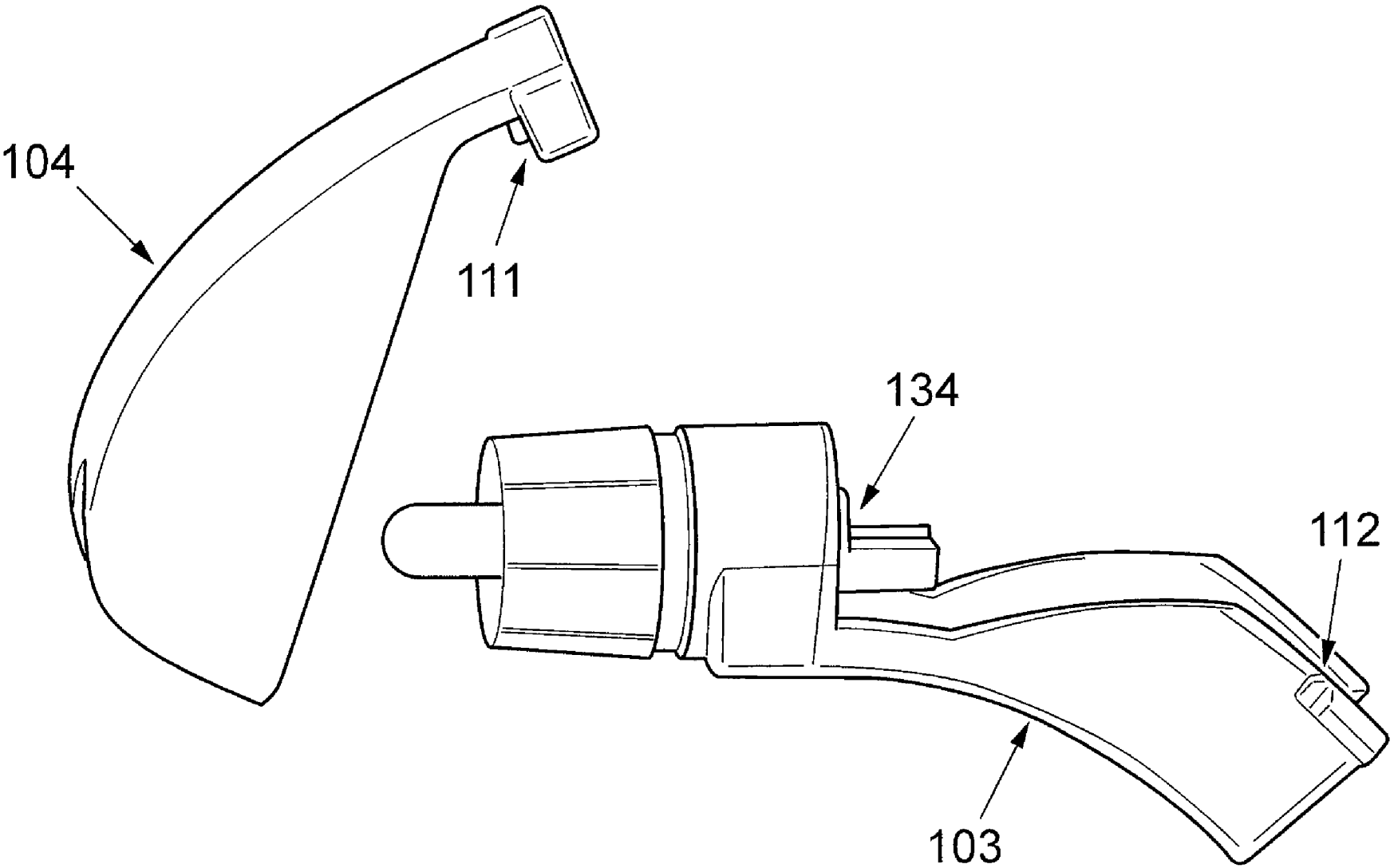
Figure 11:
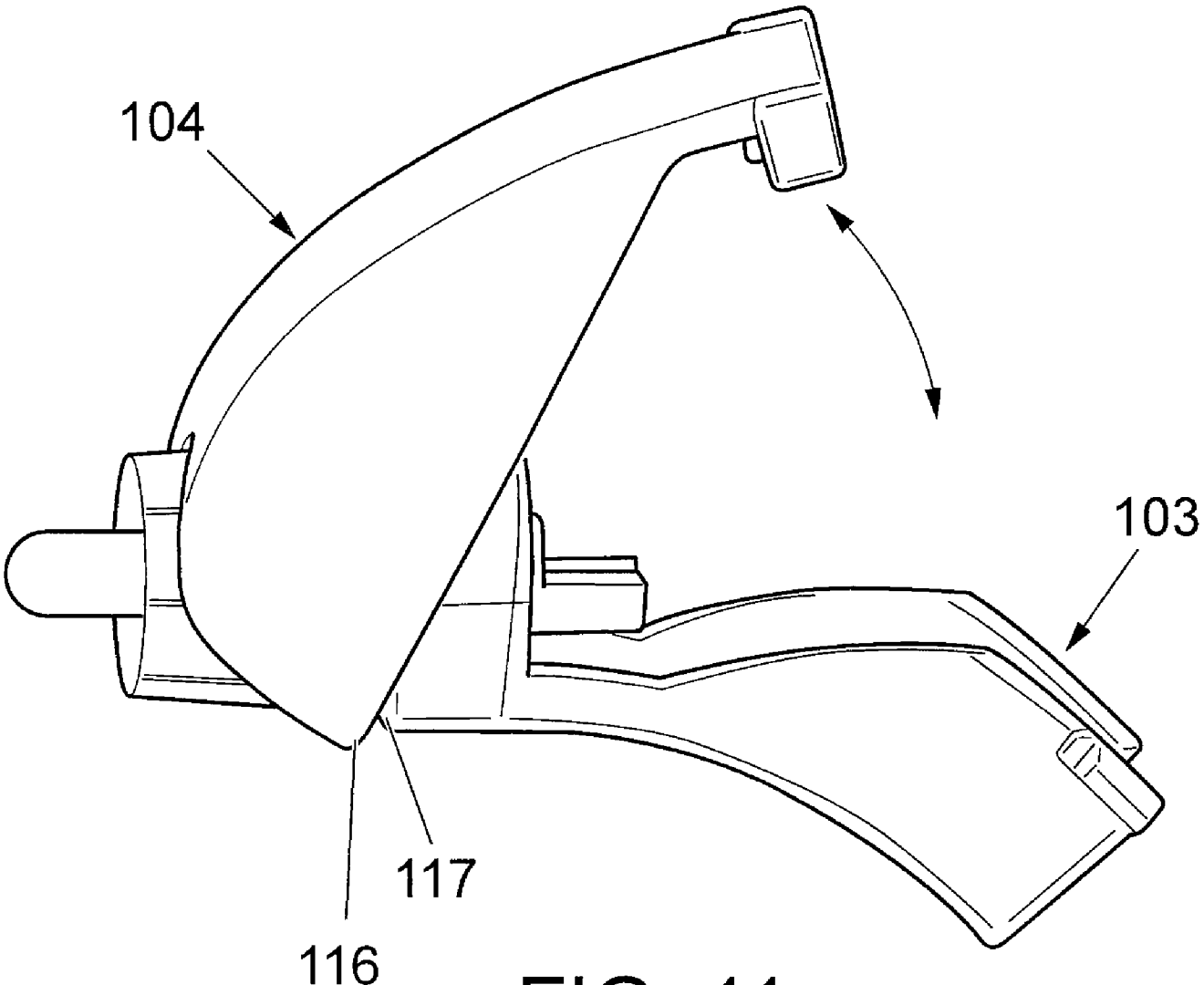
Figure 12:
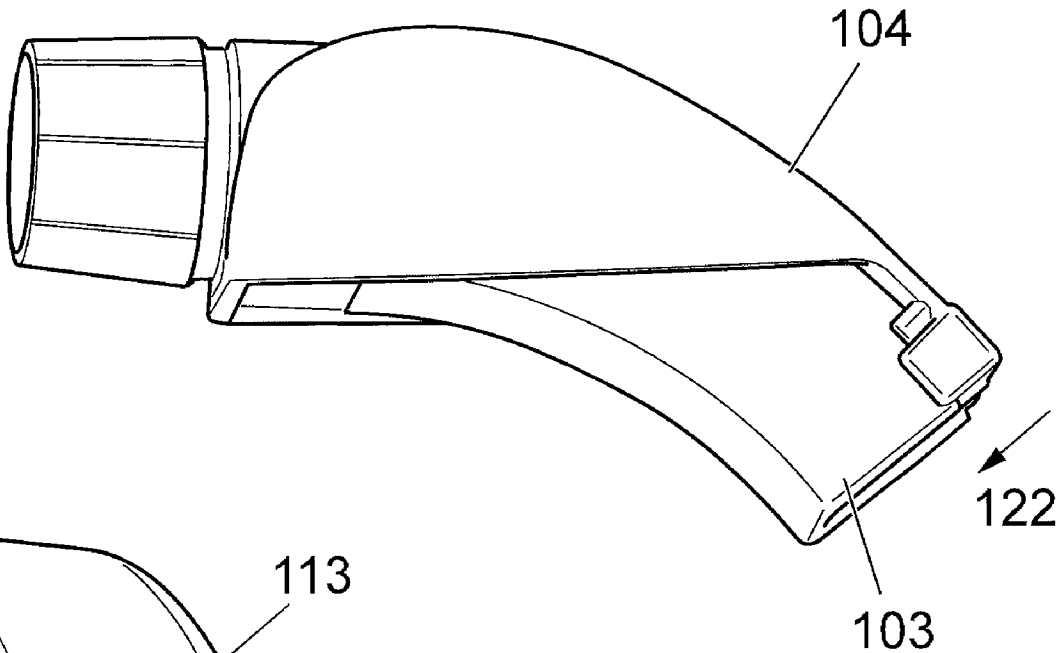
Figure 13:
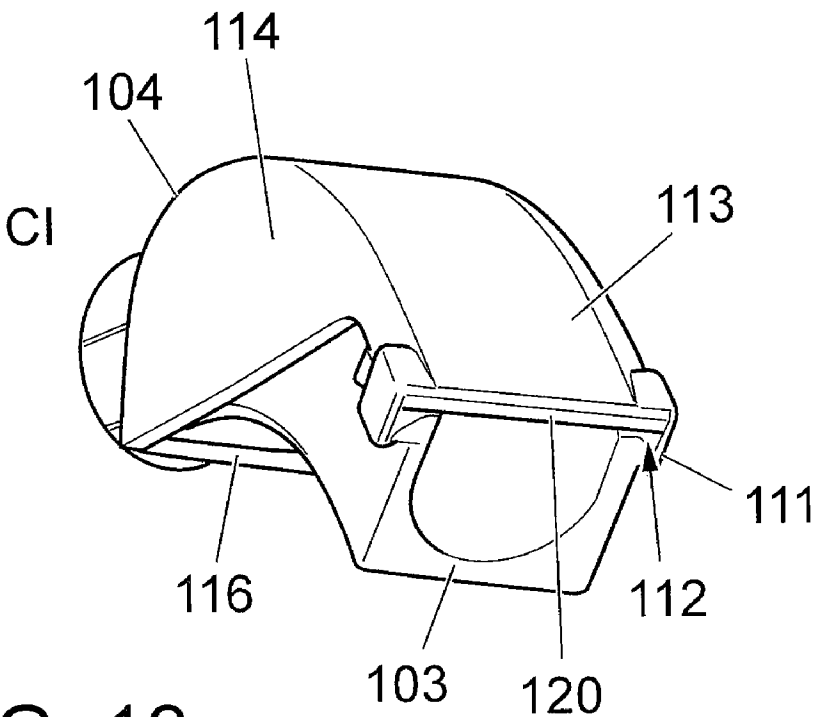
Figure 14:
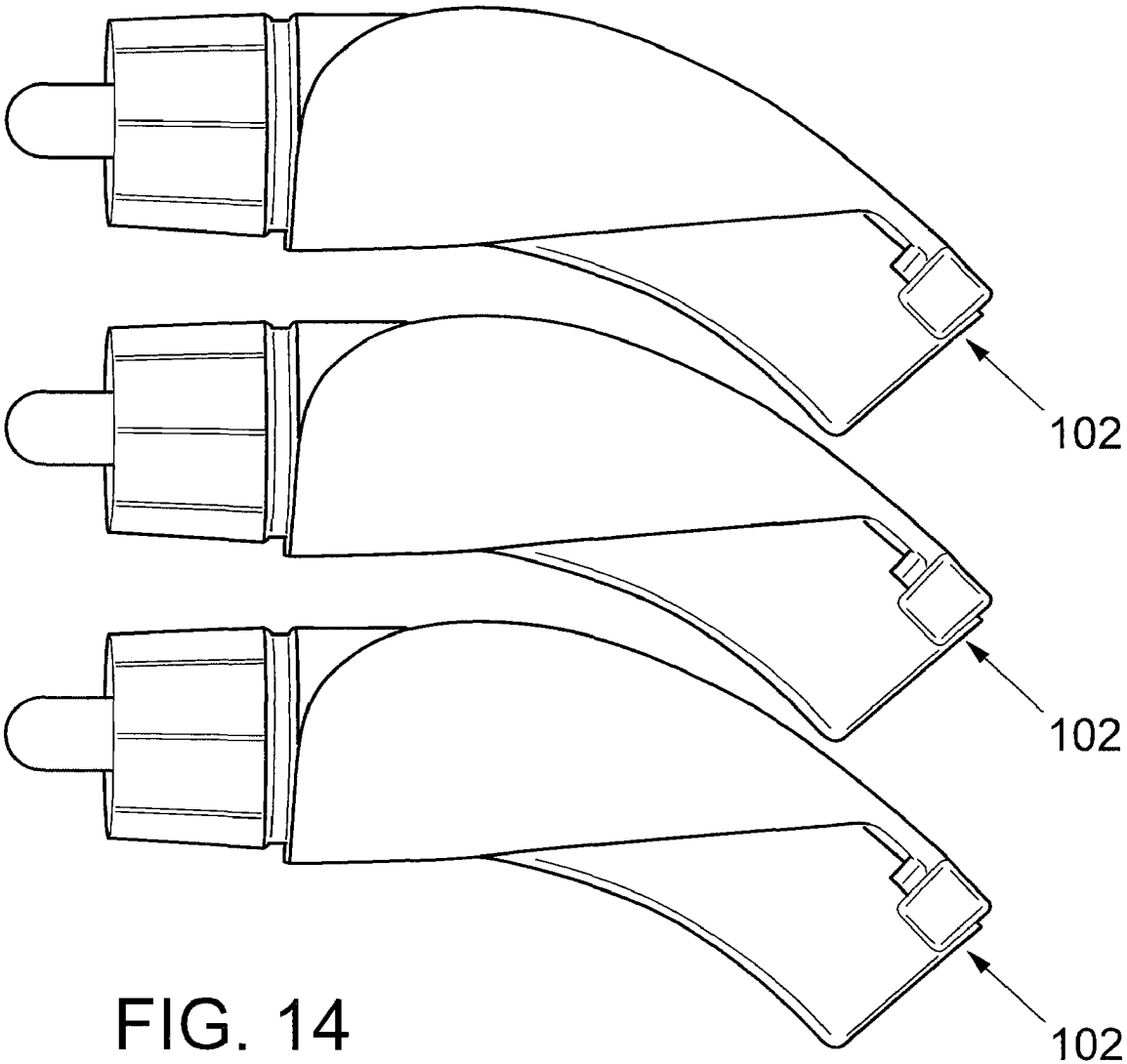

The present invention relates to a device for a connector that comprises a frame part and a casing that is arranged to be detachably interconnected with the frame part, as well as a connecting part for a cable and having a contact pin or a pin reception part, respectively, situated at mutually opposite portions of the frame part.

Known connectors, especially so-called RCA connectors, which are formed of a casing interconnectable with a frame are normally time-consuming and cumbersome to interconnect into a well working unit. The frame has preferably a circular circumference shape, which entails that the grip thereof when the contact is handled for interconnection with the intended apparatus or upon interconnection of the parts of the contact will not be the best without running the risk of sliding with the fingers when, e.g., it is desired to rotate the threads of the casing and of the frame into one another to form a working contact.

Strain relief of the connector is also important to achieve so that the cable connected to the connector does not rupture when the connector being put into and pulled out of the apparatus in question, such as, e.g., hi-fi systems. Electric connections in the form of solders on printed circuit cards are fragile and can easily break because of the leverage that is achieved when affecting straight electrical contacts. For instance, because of mechanical action due to, as an example, touching or because of the cables' own weight.

Interconnection of the cable in question with the proper frame of the contact is often made before it has been remembered to first thread the casing on, which after the interconnection of the cable should be screwed together with the frame in question. In such a case, for many contacts it has often been necessary to again loosen the cable and the contact-connected conductors thereof from the frame in order to first thread the casing on, before it again has been possible to attach the conductors of the cable to the frame by screwing.

Also close packing of contacts is desirable to be provided, but with conventional connectors, this is not easily allowed. There are electrical contacts that are angled at right angle, but close packing of such electrical contacts is not easily allowed because of the angled portion of the same and that prevents close packing, especially if said angled portions also are desired to be turned in a common direction. Neither is it possible at a close packing to connect optional electrical contacts in a desired sequence, e.g., from below or from the middle, because of the nature and function of the electrical contacts.

Thus, the main object of the present invention is primarily to provide a device that solves at least a number of said problems in a simple, reliable and efficient way.

Said object is attained by means of a device according to the present invention that essentially is characterized in that the casing has an opening for surrounding receipt of a portion of the frame part extending through the opening, and that co-operating fastening members are arranged to detachably interconnect the frame part with the casing.

The invention is described below by way of a number of preferred embodiment examples, reference being made to the accompanying drawings, in which FIG. 1 shows an electrical contact having a device according to a first embodiment example as seen from the side, FIGS. 2-7 show said contact and device in different positions and FIGS. 8-14 show an electrical contact and device with containing parts according to a second embodiment example in different positions.

A device 1; 101 for a connector 2; 102 that comprises a frame part 3; 103 and a casing 4; 104, with the casing arranged to be detachably interconnectable with the frame part 3; 103, as well as a connecting part 34; 134 for the connection of a cable 5; 105 and having a contact pin 6; 106 or a pin reception part, respectively, situated at mutually opposite portions 3A, 3B; 103A, 103B of the frame part 3; 103, is formed according to the present invention by the fact that the casing 4; 104 at one end 4A; 104A thereof has an opening 7; 107 that is adapted for surrounding receipt of a portion 3B; 103B of the frame part extending through the opening 7; 107, and that co-operating fastening members 8-10; 111-112 are arranged to detachably interconnect the frame part 3; 103 with the casing 4; 104.

Said casing 4; 104 is, in that connection, formed of an open construction along one side 4B; 104A thereof and has an upper part 13; 113, pair-wise side walls 14, 15; 114, 115 as well as an end wall 16; 116.

The opening 7; 107 is, in that connection, formed both in said end wall 16; 116 and in said upper part 13; 113 and has a circumference shape adapted to the circumference and the shape of the frame part 3; 103. Preferably, the shape of the opening 7; 107 is substantially elliptical.

In order to provide efficient retention of the casing 4; 104 on the frame part 3; 103, a remaining portion 17; 117 of the casing end wall 16; 116 forms a stopper that co-operates with and abuts closely against a transverse portion 18; 118 of the frame part 3; 103.

In order to provide efficient strain relief between a said electrical contact 2; 102 or another connector and cable 5; 105, a thickening 20; 120 is arranged on the inside 19; 119 of the casing 4; 104 and the upper part 13; 113 thereof, which thickening is arranged and adapted to, in the interconnected state I, CI with the frame part 3; 103, act on a cable 5; 105 connected to the contact 2; 102 and thereby provide said desired strain-relieving function of the contact 2; 102 in question.

Said thickening 20; 120 presses against one circumference side 5A; 105A of the cable and the cable 5; 105 is in turn pressed against the bottom portion 21; 121 of the frame part 3; 103.

Said fastening members, which are arranged to detachably be able to interconnect the casing 4; 104 and the frame part 3; 103 with each other, consist of screws 8 having mating holes 9, 10 and threads and/or of snap-in members 111, 112. In that connection, pair-wise thickened portions 111 at the outer end of the upper part 113 of the casing can resiliently grip around each a flange-like retention part 112 of the frame part 103.

In order to allow close packing of contacts 2, 2, . . . ; 102; 102 . . . , said frame part and casing have a straight or curved shape, as seen along the length extension L; CL thereof.

Thus, optional shape of the casing and frame part of the connector can now be obtained, without hindering the interconnection of the different parts. For instance, the shape may be bent as a banana or as an S, etc.

Suitably, the upper part 13; 113 of said casing is shaped as a resilient tongue. When the screws 8 are screwed into the holes 9, 10 or when the snap-in members 111, 112 snap in over each other, said upper part 13, 113 is pressed down in the direction of the arrow 22; 122 against the frame part 3; 103. Preferably, said electrical contact is formed of a plastic and/or metal materials of suitable type.

The function and nature of the invention should have been understood with the aid of what has been indicated above and shown in the drawings but the invention is naturally not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. A device for a connector, comprising:

a frame part;

a casing configured for detachable interconnection with the frame part;

a connecting part for a cable, having a contact pin or a pin reception part, the cable and contact pin or pin reception part configured to be situated at mutually opposite portions of the frame part; and co-operating fastening members, configured for detachably interconnecting the frame part with the casing;

wherein the casing has an opening for surrounding receipt of a portion of the frame part extending through the opening.

2. The device of claim 1, wherein the casing is formed of an open construction along one side thereof.

3. The device of claim 2, wherein the casing has an upper part, pair-wise side walls, and an end wall.

4. The device of claim 3, wherein the opening is formed in the end wall and in the upper part.

5. The device of claim 4, wherein the opening has a circumferential shape adapted to a circumferential shape of the frame part.

6. The device of claim 5, wherein the shape of the opening is substantially elliptical.

7. The device of any of claims 4, wherein a remaining portion of the end wall forms a stopper with a transverse portion of the frame part.

8. The device of claim 1, wherein the casing includes a thickening on an inside of the casing that is configured, when the casing is interconnected with the frame part, to act on a cable connected to the connecting part, thereby relieving cable strain.

9. The device of claim 1, wherein at least one fastening member comprises a screw or snap-in member.

10. The device of claim 1, wherein the frame part and casing have either straight or curved shapes as seen along lengths of frame part and casing.

11. A device for a connector, comprising:

a frame part;

a casing configured for detachable interconnection with the frame part, wherein the casing has an opening for surrounding receipt of a portion of the frame part extending through the opening; the casing has a thickening on an inside of the casing that is configured, when the casing is interconnected with the frame part, to act on a cable connected to the connecting part, thereby relieving cable strain; the casing is formed of an open construction along one side thereof; the casing has an upper part, pair-wise side walls, and an end wall; and the opening is formed in the end wall and in the upper part;

co-operating fastening members, configured for detachably interconnecting the frame part with the casing, and comprising at least one screw or snap-in member; and a connecting part for a cable, having a contact pin or a pin reception part, the cable and contact pin or pin reception part configured to be situated at mutually opposite portions of the frame part.

12. The device of claim 11, wherein the opening has a circumferential shape adapted to a circumferential shape of the frame part.

13. The device of claim 12, wherein the shape of the opening is substantially elliptical.

14. The device of any of claims 11, wherein a remaining portion of the end wall forms a stopper with a transverse portion of the frame part.

15. The device of claim 11, wherein the frame part and casing have either straight or curved shapes as seen along lengths of frame part and casing.

* * * * *